US008923720B2

(12) United States Patent
Uchida et al.

(10) Patent No.: US 8,923,720 B2
(45) Date of Patent: Dec. 30, 2014

(54) CONTROL PANEL SUPPORT MECHANISM, CONTROL PANEL ASSEMBLY, AND IMAGE FORMING APPARATUS

(75) Inventors: Naotaka Uchida, Toyokawa (JP); Akira Yamamura, Toyokawa (JP); Kenji Sawada, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 885 days.

(21) Appl. No.: 13/074,229

(22) Filed: Mar. 29, 2011

(65) Prior Publication Data

US 2011/0235254 A1 Sep. 29, 2011

(30) Foreign Application Priority Data

Mar. 29, 2010 (JP) ..... 2010-074310

(51) Int. Cl.
*G03G 15/00* (2006.01)

(52) U.S. Cl.
CPC ..... *G03G 15/5016* (2013.01)
USPC ..... 399/81; 361/679.02; 248/636

(58) Field of Classification Search
CPC ..... G06F 1/16; G06F 1/1616; G06F 1/1681; G06F 1/185; G06F 1/187; G06F 1/1679; G06F 1/1607; G06F 1/1632; G06F 1/1637
USPC ..... 399/81; 361/679.02; 248/637
See application file for complete search history.

(56) References Cited

U.S. PATENT DOCUMENTS

2008/0062444 A1 3/2008 Sugawara et al.
2008/0122795 A1 * 5/2008 Sawada et al. ..... 345/173

FOREIGN PATENT DOCUMENTS

JP 2006262040 A * 9/2006
JP 2008-006625 A 1/2008
JP 2008-065245 A 3/2008
JP 2008-134362 A 6/2008
JP 2008-134363 A 6/2008

OTHER PUBLICATIONS

English machine translation of JP 2006-262040 A.*
Office Action (Notification of Reasons for Refusal) dated Mar. 21, 2012, issued in corresponding Japanese Patent Application No. 2010-074310, and an English Translation thereof (with Verification of Translation). (6 pages).

* cited by examiner

*Primary Examiner* — Walter L Lindsay, Jr.
*Assistant Examiner* — Ruth Labombard
(74) *Attorney, Agent, or Firm* — Buchanan Ingersoll & Rooney PC

(57) ABSTRACT

Provided is a control panel support mechanism having a first support member attached to an image forming apparatus, a second support member supporting a control panel and axially supported by the first support member to be vertically swingable with respect to the first support member, a lock member slidable towards or away from a swing axis of the second support member, and a biasing unit to bias the lock member to slide towards the swing axis. The first support member has a plurality of engaging grooves each positioned along a radial direction with respect to the swing axis and having an opening at an end of the first support member opposite the swing axis, the plurality of engaging grooves being aligned vertically. The biasing unit biases the lock member so that the lock member enters one of the plurality of engaging grooves through the opening to lock in engagement with the engaging groove.

17 Claims, 14 Drawing Sheets

CONTROL PANEL SUPPORT MECHANISM, CONTROL PANEL ASSEMBLY, AND IMAGE FORMING APPARATUS

This application is based on an application No. 2010-74310 filed in Japan, the contents of which are hereby incorporated by reference.

BACKGROUND OF THE INVENTION (1) Field of the Invention

The present invention relates to a control panel support mechanism mounted on an image forming apparatus to support a control panel, to a control panel assembly in which a control panel is supported by such a control panel support mechanism, and to an image forming apparatus provided with such a control panel assembly.

(2) Description of the Related Art

Image forming apparatuses such as copiers or printers, as well as image reading apparatuses such as scanners, are sometimes provided with a large control panel that integrates an input control unit and a display unit. The input control unit is for inputting a variety of information, and the display unit displays the input information, the operational status of the device, etc. Patent Literature 1 (Japanese Patent Application Publication No. 2008-134363) discloses a large control panel that is separate from an image forming apparatus or the like. The control panel is mounted on the image forming apparatus so as to be supported by a control panel support mechanism.

In Patent Literature 1, the input control unit of the control panel is attached to the control panel support mechanism, and the display screen of the display unit is inclined with respect to the input unit at an obtuse angle of less than 180°. The control panel support mechanism is configured so that when the control panel is swung vertically with respect to the image forming apparatus or the like, the input control unit of the control panel can be locked in either a nearly horizontal state or in an inclined state at a predetermined angle.

A user in a wheelchair, for example, can swing the control panel with this structure downwards and lock the input control unit in the inclined state. This enables the user to operate the input control unit while seated in a wheelchair. Moreover, this structure also enables the user to see the display screen of the display unit clearly.

In the panel mechanism disclosed in Patent Literature 1, the control panel support mechanism is provided with a first support member on which a plurality of locking holes are vertically formed, a second support member having a locking lug configured to move vertically with respect to the first support member and to be inserted in each locking hole, and an operation member configured to slide the locking lug in a direction to extract the locking lug from the locking hole.

The locking lug of the second support member is in the shape of a pin and is biased so as to be inserted into the lock holes. When the locking lug is inserted into a locking hole, the control panel is locked so as not to be vertically swingable. By operation of the operation member, the locking lug slides in a direction to be extracted from the locking hole. The control panel is thus unlocked and becomes capable of being swung vertically.

In the structure in Patent Literature 1, an appropriate amount of space is required between the pin-shaped locking lug and vertical edges of the locking holes in order for the locking lug to be smoothly inserted into each locking hole by the bias of a biasing unit. In such a structure, the locking lug may vibrate vertically in the locking holes. To address this problem, Patent Literature 1 recites applying a bias to the locking lug so that the locking lug comes into contact with the upper edge of each locking hole. This prevents the locking lug from vibrating once inserted into the locking holes.

However, even this structure has the problem that if an unreasonable force is applied to the input control unit in the control panel so as to swing the control panel downwards, the locking lug will swing downwards in the locking hole, causing the control panel to swing downwards.

Furthermore, when the locking lug is inserted into or extracted from the locking holes, the locking lug may slide against the upper or lower edges of the locking holes. Accordingly, the locking lug, as well as either or both of the vertical edges of the locking holes, will become worn over time if the locking lug is repeatedly inserted into and extracted from the locking holes. This will increase the space between the locking lug and the locking holes, resulting in the control panel being swung downwards upon application of a large force.

SUMMARY OF THE INVENTION

It is a first object of the present invention to provide a control panel support mechanism that reliably prevents the control panel from vibrating over an extended period of time. It is a second object of the present invention to provide a control panel assembly and an image forming apparatus that include such a control panel support mechanism.

In order to achieve the first object, a control panel support mechanism according to the present invention is for supporting a control panel of an image forming apparatus so that the control panel is vertically swingable with respect to the image forming apparatus and comprises: a first support member configured to be attached to the image forming apparatus; a second support member configured to support the control panel and axially supported by the first support member to be vertically swingable with respect to the first support member; a lock member configured to be slidable towards or away from a swing axis of the second support member; and a biasing unit configured to bias the lock member to slide towards the swing axis, wherein the first support member has a plurality of engaging grooves each positioned along a radial direction with respect to the swing axis and having an opening at an end of the first support member opposite the swing axis, the plurality of engaging grooves being aligned vertically, and the biasing unit biases the lock member so that the lock member enters one of the plurality of engaging grooves through the opening to lock in engagement with the engaging groove.

In order to achieve the second object, a control panel assembly according to the present invention includes the control panel support mechanism and a control panel supported by the control panel support mechanism. Furthermore, An image forming apparatus according to the present invention includes the control panel assembly.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings.

DESCRIPTION OF THE PREFERRED EMBODIMENTS

Structure of Image Forming Apparatus

Figure 1:
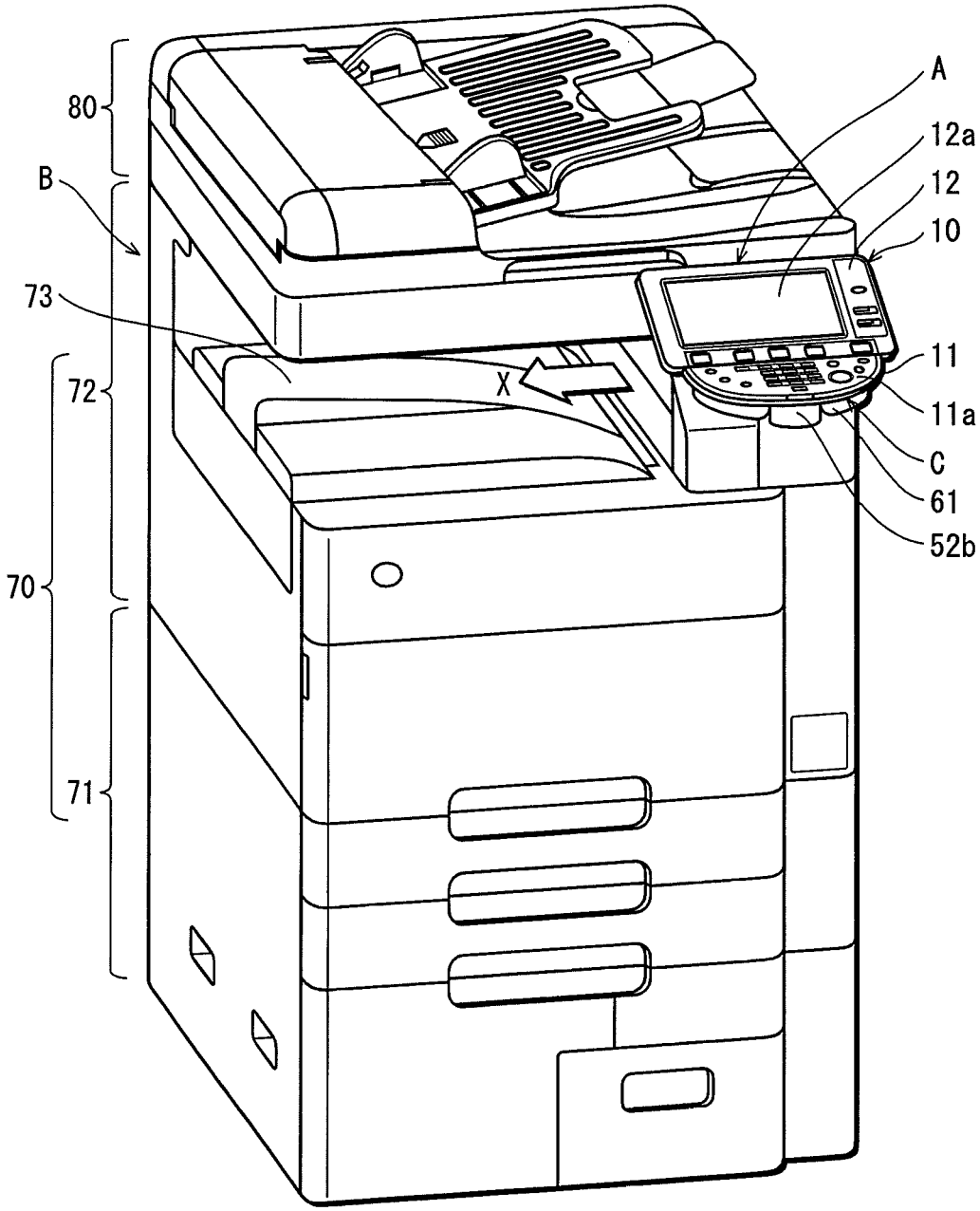
FIG. 1 is a perspective view of an image forming apparatus that includes a control panel assembly in which a control panel is supported by a control panel support mechanism according to an embodiment of the present invention.

FIG. 1 is a perspective view of an image forming apparatus formed by a control panel assembly A and an image forming apparatus body B. A control panel in the control panel assembly A is supported by a control panel support mechanism according to the embodiment of the present invention.

The image forming apparatus body B forms an image on a recording sheet by well-known electrophotography and includes an image forming unit 70 and an image reading unit 80 provided above the image forming unit 70. The image forming unit 70 includes a paper tray 71 at the lowest part the body B for storing recording sheets and an image forming subunit 72 provided above the paper tray 71 for forming a toner image on a recording sheet fed from the paper tray 71.

On the upper surface of the image forming unit 70, between the image forming unit 70 and the image reading unit 80, a sheet ejection unit 73 is formed for ejecting a recording sheet on which a toner image is formed in the direction indicated by the arrow X.

The control panel assembly A is attached to the front plate of the image reading unit 80, which is located upstream from the sheet ejection unit 73 in the ejection direction (direction of the arrow X) of the recording sheet.

Control Panel Assembly

Figure 2:
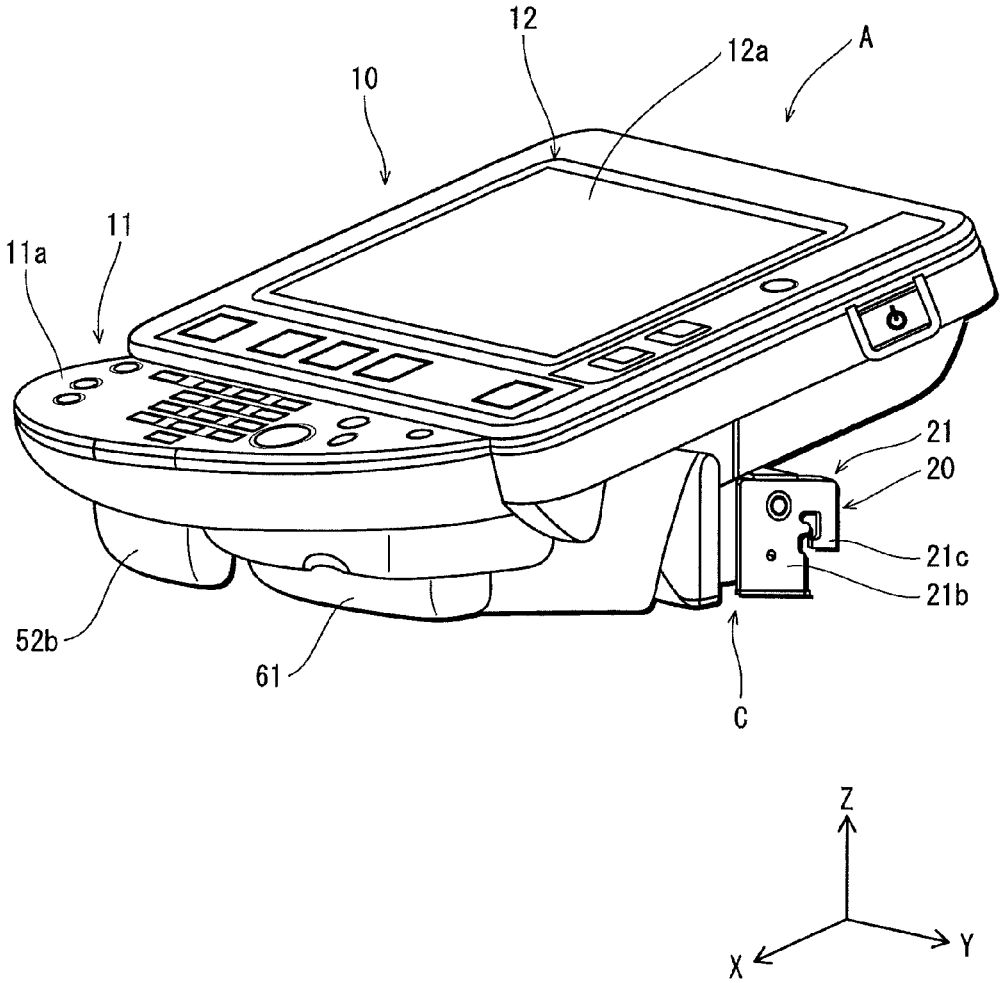
FIG. 2 is a perspective view of the control panel assembly removed from the image forming apparatus.

FIG. 2 is a perspective view of the control panel assembly A as removed from the front plate of the image reading unit 80. The control panel assembly A includes a control panel support mechanism C that attaches to the front plate of the image reading unit 80 and a control panel 10 supported by the control panel support mechanism C.

The control panel support mechanism C protrudes horizontally out from the front plate of the image reading unit 80 and supports the control panel 10 so that the control panel 10 can be swung vertically and horizontally and can also be locked in a plurality of vertical positions so as not to swing vertically.

Hereinafter, the direction away from the image reading unit 80 is referred to as the front (x direction in FIG. 2) and the opposite direction referred to as the back. When facing the front plate of the image reading unit 80, the left and right sides are simply referred to as such, with the right side corresponding to the y direction in FIG. 2. Furthermore, the upwards direction corresponds to the z direction in FIG. 2.

Note that FIG. 2 shows the control panel 10 locked in the uppermost position with respect to the control panel support mechanism C. Part of the control panel support mechanism C is covered by a cover 61.

Figure 3:
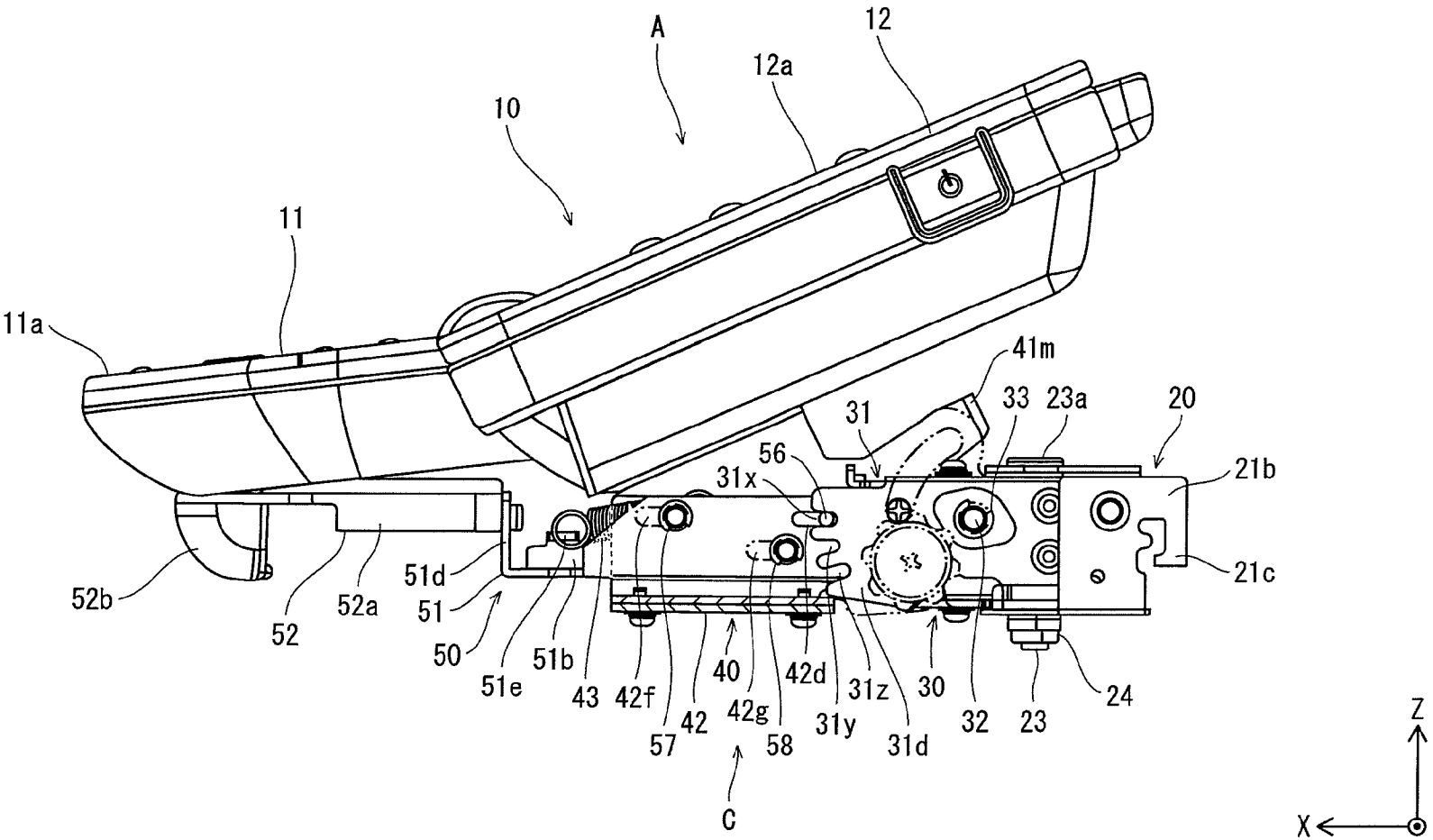
FIG. 3 is a right-side view of the control panel assembly showing a cross-section of the control panel support mechanism with a cover removed.

FIG. 3 is a side view of the control panel assembly A showing a cross-section of the control panel support mechanism C with the cover 61 removed.

As shown in FIGS. 2 and 3, the control panel 10 has, at the front (x direction) of the image reading unit 80, an input control unit 11 attached to the control panel support mechanism C. The control panel 10 also has, further back (in the direction opposite to the x direction) than the input control unit 11, a display unit 12 that is provided at an incline, with the back of the display unit 12 being tilted upwards.

The input control unit 11 is an arc-shaped projection formed at the front (x direction) of the display unit 12. The upper surface of the input control unit 11 is an operation screen 11*a* provided with a ten-key or other input unit. When the control panel 10 is locked in the uppermost (z direction) position with respect to the control panel support mechanism C (position in FIG. 2), the operation screen 11*a* is inclined so that the front (the side in the x direction) is inclined downwards with respect to the horizon at an inclination angle of 5°-10°.

The display unit 12 is provided with a liquid crystal display panel having a touch-screen. On the upper surface of the display unit 12 is a display screen 12*a* that allows operation of the touch-screen. The display screen 12*a* forms an obtuse angle of approximately 160°-170° with respect to the operation screen 11*a* of the input control unit 11.

As shown in FIG. 3, the control panel support mechanism C includes an attachment member 20, a first support member 30, a second support member 40, and an operation member 50. The attachment member 20 is attached to the front plate of the image reading unit 80 so as to protrude horizontally toward the front (x direction). The first support member 30 is attached to the attachment member 20 so as to be swingable horizontally. The second support member 40 is attached to the first support member 30 so as to be swingable vertically. The operation member 50 is attached to the second support member 40 so as to be slidable forwards and backwards (in the x direction and the opposite direction).

Figure 4:
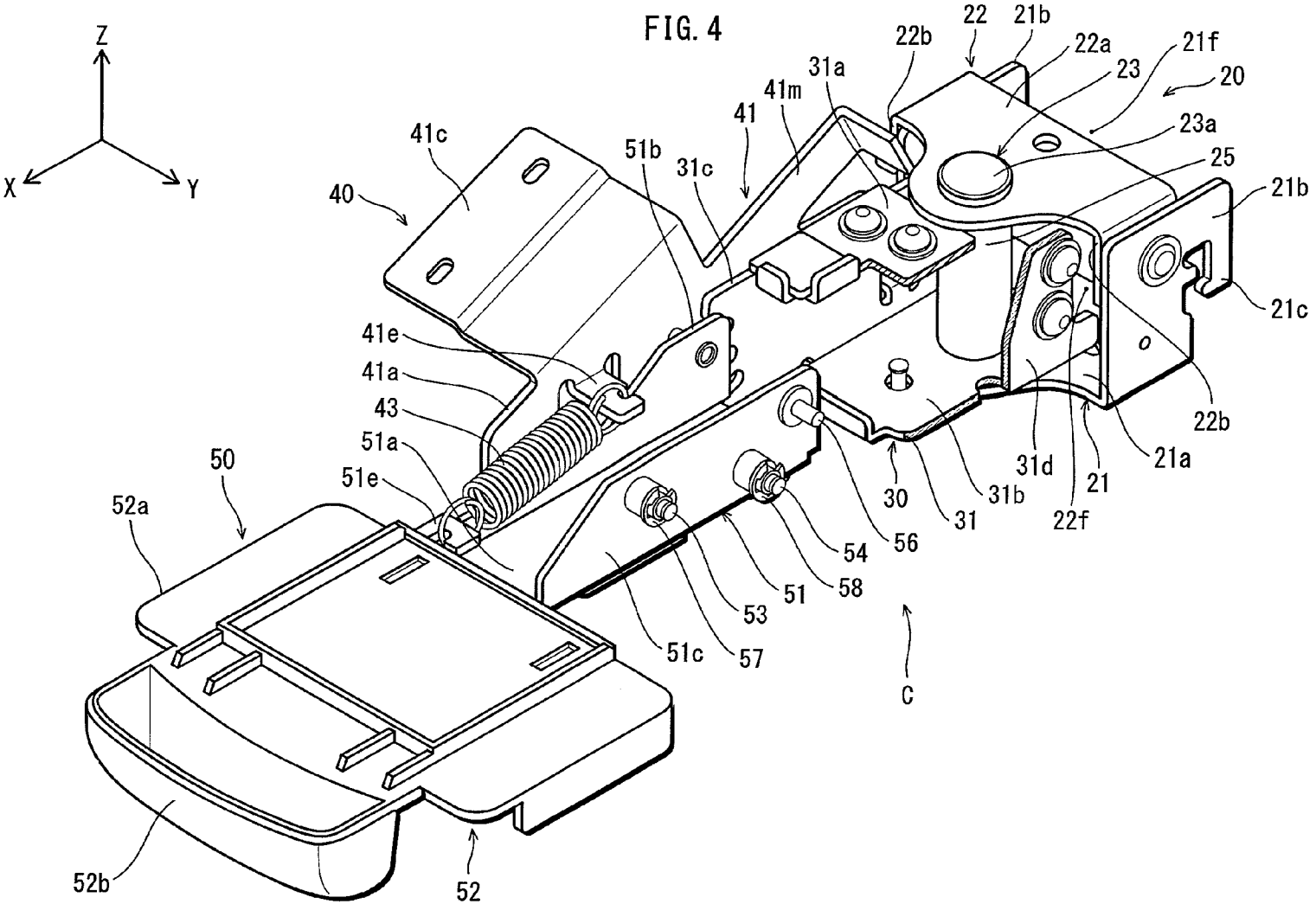
FIG. 4 is a perspective view of the control panel support mechanism with the cover removed, showing part of the control panel support mechanism cut away.
Figure 5:
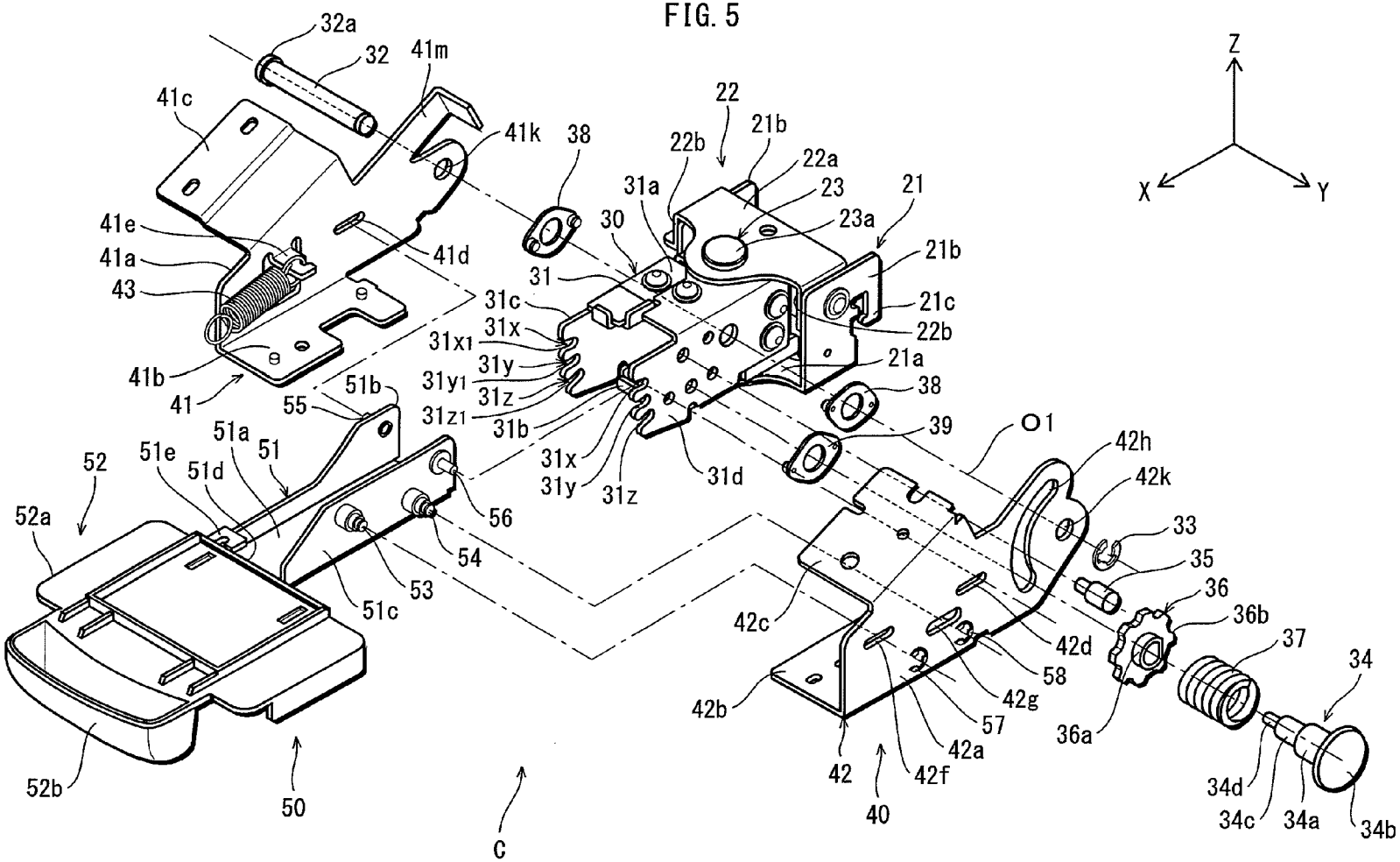
FIG. 5 is an exploded perspective view of the control panel support mechanism with the cover removed.
Figure 6:
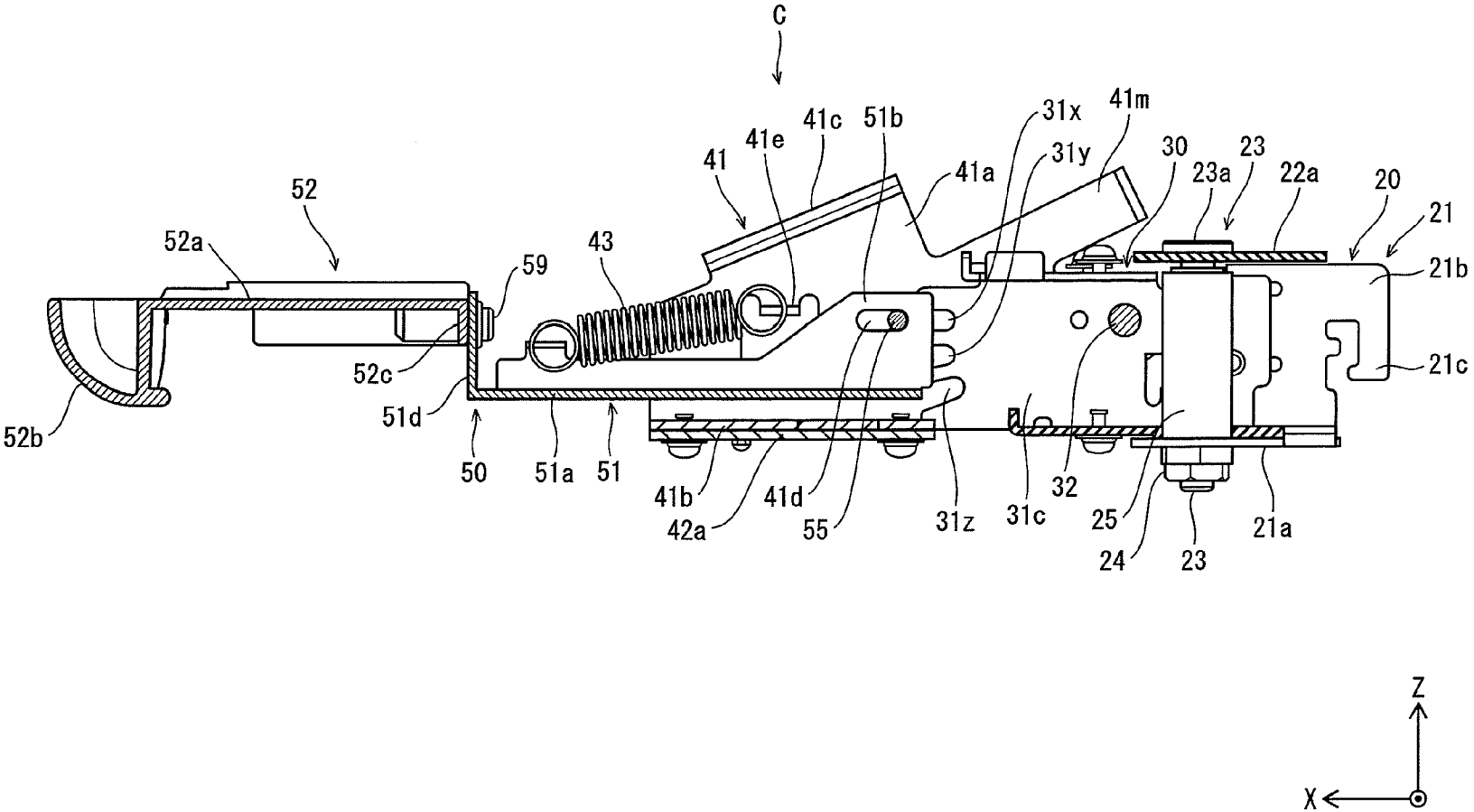
FIG. 6 is a longitudinal cross-section diagram of the control panel support mechanism with the cover removed.
Figure 7:
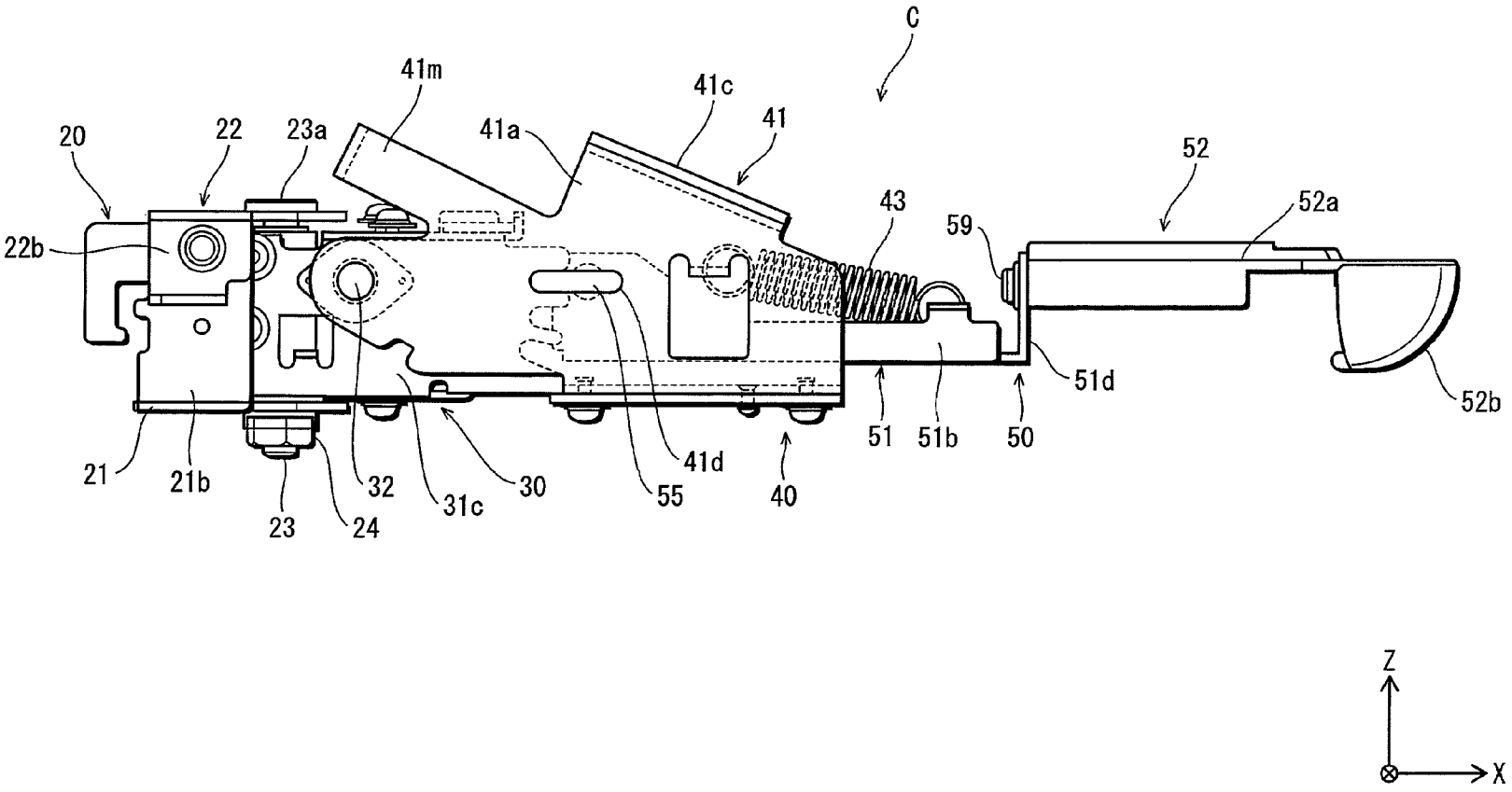
FIG. 7 is a left-side view of the control panel support mechanism with the cover removed.

FIG. 4 is a perspective view of the control panel support mechanism C with the cover 61 removed, showing part of the control panel support mechanism C cut away. FIG. 5 is an exploded perspective view of the control panel support mechanism C with the cover 61 removed, FIG. 6 is a longitudinal cross-section diagram thereof, and FIG. 7 is a left-side view thereof.

The attachment member 20 is provided with a channel-shaped (groove-shaped) support bracket 21 attached to the front plate of the image reading unit 80 so that an opening 21*f* (see FIG. 4) thereof opens upwards (in the z direction) The support bracket 21 is formed from metal or other plate material and includes a bottom face 21*a*, opposite the upper opening 21*f*, and lateral faces 21*b* that extend upwards (in the z direction) vertically from each lateral edge of the bottom face 21*a*.

The lateral faces 21*b* on either side of the support bracket 21 are each provided with a catch 21*c* that catches to the front plate of the image reading unit 80. The catch 21*c* is located at the back (opposite direction to the x direction) of each lateral face 21*b*. The bottom face 21*a* is supported in a nearly horizontal position by the catches 21*c* catching to the front plate of the image reading unit 80. The front side of the bottom face 21*a* is a semi-circle projecting towards the front (x direction).

A channel-shaped (groove-shaped) connecting bracket 22 is attached to the support bracket 21 so that an opening 22*f* (see FIG. 4) thereof opens downwards. The connecting bracket 22 is also formed from metal or other plate material and includes an upper face 22*a*, opposite the lower opening 22*f*, and lateral faces 22*b* that extend downwards vertically from each lateral edge of the upper face 22*a*.

The lateral faces 22*b* of the connecting bracket 22 are bent nearly vertically downwards from the upper face 22*a* so as to be formed along the respective lateral faces 21*b* of the support bracket 21. The lateral faces 22*b* of the connecting bracket 22 are attached to the lateral faces 21*b* of the support bracket 21 with screws.

Like the bottom face 21*a* of the support bracket 21, the front side of the upper face 22*a* of the connecting bracket 22 is a semi-circle projecting towards the front (x direction). The two semi-circular projections face each other and are penetrated by a horizontal swing shaft 23. The horizontal swing shaft 23 is provided with a head 23*a* at the top thereof. The head 23*a* abuts against the upper face 22*a* of the connecting bracket 22. In the horizontal swing shaft 23, a sleeve 25 (see FIG. 4) is fit between the upper face 22*a* of the connecting bracket 22 and the bottom face 21*a* of the support bracket 21.

The bottom of the horizontal swing shaft 23 extends downwards (in the direction opposite to the z direction) from the bottom face 21*a* of the support bracket 21. A nut 24 (see FIG. 3) is attached to the part extending downwards. The horizontal swing shaft 23 is thus prevented from being extracted from the support bracket 21 and the connecting bracket 22 and is fixed vertically between the two brackets.

The first support member 30 is a hollow, rectangular parallelepiped having a positioning body 31 positioned so that its axial direction is horizontal. The positioning body 31 has a rectangular cross-section and is formed by a horizontal upper face 31*a* and lower face 31*b* (see FIG. 4), and by a vertical first side face 31*c* and vertical second side face 31*d* on either side. The upper face 31*a*, the lower face 31*b*, and the first side face 31*c* and second side face 31*d* are formed from metal or other plate material.

The horizontal back end (the end in the direction opposite to the x direction) of the positioning body 31 is located between the bottom face 21*a* of the support bracket 21 and the upper face 22*a* of the connecting bracket 22. The horizontal swing shaft 23 penetrates the upper face 31*a* and the lower face 31*b* at the back end. The positioning body 31 can thus be swung horizontally to the left and right (in the y direction and the opposite direction) around the horizontal swing shaft 23, which is positioned vertically.

The first side face 31*c* and the second side face 31*d*, which are formed as flat plates, extend farther to the front (in the x direction) than the upper face 31*a* and the lower face 31*b*. On the front end (the end in the x direction) of each of the side faces, a first engaging groove 31*x*, second engaging groove 31*y*, and third engaging groove 31*z* are provided in vertical alignment in this order from the top. The first engaging grooves 31*x*, second engaging grooves 31*y*, and third engaging grooves 31*z* provided on both the first side face 31*c* and the second side face 31*d* face each other and respectively have the same structure.

The second engaging groove 31*y* is provided in approximately the vertical center at a predetermined distance from both the first engaging groove 31*x* above and the third engaging groove 31*z* below. The first engaging groove 31*x*, second engaging groove 31*y*, and third engaging groove 31*z* respectively have openings 31*x*1, 31*y*1, and 31*z*1 (see FIG. 5) located at the front side (the side in the x direction). Details on the structure of the first engaging groove 31*x*, second engaging groove 31*y*, and third engaging groove 31*z* are provided below.

As shown in FIG. 5, the ends of a vertical swing shaft 32, which is positioned horizontally, respectively penetrate the first side face 31*c* and the second side face 31*d* of the positioning body 31 approximately above the lateral center of each side face. The vertical swing shaft 32 is provided with a head 32*a* at one end thereof. With the head 32*a* located at the left side (opposite to the y direction) of the first side face 31*c*, the vertical swing shaft 32 penetrates the first side face 31*c* and the second side face 31*d*. The other end of the vertical swing shaft 32 penetrates the second side face 31*d* and extends beyond the right side (y direction) of the second side face 31*d*.

As shown in FIG. 5, an adjustment screw member 34 is screwed into the second side face 31*d*, i.e. the right side of the positioning body 31, at the lower part of the side face near the front (x direction). As described below, this adjustment screw member 34 is provided for adjusting resistance to swinging when the second support member 40 is swung vertically. Furthermore, a fixing pin 35 is provided above the adjustment screw member 34 to prevent the adjustment screw member 34 from swinging. The fixing pin 35 is provided on the perimeter of a circle having, as a radius, a line directly connecting the axis of the vertical swing shaft 32 with the axis of the adjustment screw member 34. Details on the adjustment screw member 34 and the fixing pin 35 are provided below.

As shown in FIG. 5, the second support member 40, which is attached to the first support member 30 so as to be vertically swingable, is provided with a left and right pair of a first vertical swing bracket 41 and a second vertical swing bracket 42. These swing brackets are attached to the vertical swing shaft 32 so as to swing vertically along the first side face 31*c* and the second side face 31*d* of the positioning body 31. The first vertical swing bracket 41 and the second vertical swing bracket 42 are each formed from metal or other plate material.

The first vertical swing bracket 41 and the second vertical swing bracket 42 respectively have a first side face 41*a* and a first side face 42*a*. The first side face 41*a* and the first side face 42*a* swing vertically along the outer face of the first side face 31*c* and the second side face 31*d*, respectively, of the positioning body 31. The first side face 41*a* and the second side face 42*a* are respectively provided with a first bottom face 41*b* and a second bottom face 42*b* that are bent at nearly a right angle towards the opposing side face. The first bottom face

41*b* and the second bottom face 42*b* are both flat. The second bottom face 42*b* lies on top of the first bottom face 41*b*, and the two bottom faces are screwed together.

The horizontal back ends (the ends in the direction opposite to the x direction) of the first side face 41*a* and the second side face 42*a* are respectively provided with a through-hole 41*k* and a through-hole 42*k*. The two ends of the vertical swing shaft 32 respectively penetrate the through-holes 41*k* and 42*k*. The first side face 41*a* and the second side face 42*a* are swingably supported by the vertical swing shaft 32 due to the vertical swing shaft 32 penetrating the through-holes 41*k* and 42*k*.

The head 32*a* of the vertical swing shaft 32 comes into contact with the first side face 41*a*. The other end of the vertical swing shaft 32 penetrates the second side face 42*a* and extends beyond the right side (y direction) of the second side face 42*a*. The part that extends beyond the right side is retained by a retaining ring (E ring) 33 attached thereto. So that the second support member 40 swings vertically around the vertical swing shaft 32, the center position of the vertical swing shaft 32 is the vertical swing center O1 of the second support member 40.

On the vertical swing shaft 32, a sliding ring 38 is fit between the first side face 41*a* of the first vertical swing bracket 41 and the first side face 31*c* of the positioning body 31, and another sliding ring 38 is fit between the second side face 42*a* of the second vertical swing bracket 42 and the second side face 31*d* of the positioning body 31. The sliding rings 38 are attached to the first side face 31*c* and the second side face 31*d* of the positioning body 31 so that the first side face 41*a* and the second side face 42*a* smoothly slide along the first side face 31*c* and the second side face 31*d*.

A portion in approximately the front lateral half (the portion in the x direction) of the upper edge of the first side face 41*a* and the second side face 42*a* is inclined so as to rise higher towards the back end (the end in the direction opposite to the x direction). Along the inclined upper edge of the first side face 41*a*, a first support face 41*c* is provided. The first support face 41*c* is bent at nearly a right angle in the opposite direction from which the first bottom face 41*b* is bent. Along the inclined upper edge of the second side face 42*a*, a second support face 42*c* is provided. The second support face 42*c* is bent at nearly a right angle in the same direction in which the second bottom face 42*b* is bent (the same direction in which the first support face 41*c* is bent).

The back face of the input control unit 11 in the control panel 10 is attached to the top of the first support face 41*c* and the second support face 42*c*. The control panel 10 is thus integrally supported by the first support face 41*c* and the second support face 42*c*. As the first support face 41*c* and the second support face 42*c* swing vertically, the control panel 10 also swings vertically.

The approximate lateral centers (in the x direction and opposite direction) of the first side face 41*a* of the first vertical swing bracket 41 and the second side face 42*a* of the second vertical swing bracket 42 respectively face the front ends (the ends in the x direction) of the first through third engaging grooves 31*x*-31*z* in the first side face 31*c* and in the second side face 31*d* of the positioning body 31. A rectangular first guide hole 41*d* and rectangular second guide hole 42*d* are respectively provided in the first side face 41*a* and the second side face 42*a* in the approximate vertical centers of the areas where the side faces and the front ends of the engaging grooves face each other.

The central axis along the direction of length of the first guide hole 41*d* and the second guide hole 42*d* are provided along a radial direction with respect to a line between the first side face 41*a* and the second side face 42*a* passing through the center position of the vertical swing shaft 32, i.e. the vertical swing center O1 of the second support member 40.

A rectangular front slide hole 42*f* is provided in the front side (side in the x direction) of the second side face 42*a* of the second vertical swing bracket 42. The central axis along the direction of length of the front slide hole 42*f* is located along the same line as the central axis along the direction of length of the second guide hole 42*d*. Furthermore, a rectangular central slide hole 42*g* is provided below the lateral center (in the x direction and opposite direction) of the second side face 42*a*, close to and in front (in the x direction) of the second guide hole 42*d*. The central axis along the direction of length of the central slide hole 42*g* is parallel to the central axis along the direction of length of the second guide hole 42*d*.

Note that the first bottom face 41*b* and the second bottom face 42*b* of the first vertical swing bracket 41 and the second vertical swing bracket 42 are respectively parallel to the central axis in the direction of length of the front slide hole 42*f*.

As shown in FIGS. 5-7, a swing restriction member 41*m* is provided at the back side (the side in the direction opposite to the x direction) of the first side face 41*a* of the first vertical swing bracket 41, extending upwards from approximately the lateral center of the first side face 41*a*. The back edge of the swing restriction member 41*m* is bent at a right angle so as to be positioned above the upper face 31*a* in the positioning body 31. As described below, the swing restriction member 41*m* restricts swinging of the control panel 10 when the control panel 10 is swung into a vertical position.

A through-hole 42*h* is provided on the second side face 42*a* of the second vertical swing bracket 42, between the second guide hole 42*d* and the vertical swing shaft 32. The adjustment screw member 34 and the fixing pin 35 pass through the through-hole 42*h*. The through-hole 42*h* has an arc-shape along the perimeter of a circle having, as a radius, a line directly connecting the swing center O1, i.e. the axis of the vertical swing shaft 32, with the axis of the adjustment screw member 34.

Accordingly, the second vertical swing bracket 42 swings smoothly in the vertical direction by the adjustment screw member 34 and the fixing pin 35 sliding in the through-hole 42*h*. When the second bottom face 42*b* of the second vertical swing bracket 42 is nearly horizontal, the adjustment screw member 34 is located at the lowest edge (the edge in the direction opposite to the z direction) of the through-hole 42*h*. Furthermore, when the second vertical swing bracket 42 is swung downwards (in the direction opposite the z direction) so that the second bottom face 42*b* is nearly perpendicular, the fixing pin 35 is located at the highest edge (the edge in the z direction) of the through-hole 42*h*.

As shown in FIG. 5, the adjustment screw member 34 has a cylindrical shaft body 34*a*. At one end of the shaft body 34*a*, a rotation knob 34*b* is provided along the same axis as the shaft body 34*a*. The rotation knob 34*b* is a circular plate with a larger radius than the shaft body 34*a*. At the other end of the shaft body 34*a*, a connecting part 34*c* is provided, a cross section of which is in the shape of the letter D. The connecting part 34*c* is a shaft with a smaller radius than the shaft body 34*a* and is provided along the same axis as the shaft body 34*a*. Furthermore, at the opposite side of the connecting part 34*c* as the shaft body 34*a*, a screw part 34*d* is provided. The screw part 34*d* is a shaft with a smaller radius than the connecting part 34*c* and has a screw groove on the outer circumferential surface thereof.

The connecting part 34*c* of the adjustment screw member 34 passes through the through-hole 42*h* in the second side face 42*a* of the second vertical swing bracket 42 and through a sliding ring 39 provided between the second side face 42*a* and the second side face 31*d* of the positioning body 31. The screw part 34*d* is screwed into the second side face 31*d* of the positioning body 31. A swing restriction member 36 is fitted onto the connecting part 34*c*, and between the swing restriction member 36 and the rotation knob 34*b*, a compression spring 37 is fitted on the connecting part 34*c* and the shaft body 34*a*.

The swing restriction member 36 has a tubular portion 36*a* and a flange 36*b*. A cross section of the tubular portion 36*a* is in the shape of the letter D to match the connecting part 34*c* of the adjustment screw member 34. The flange 36*b* is provided at the end of the tubular portion 36*a* on the side of the second side face 42*a* of the second vertical swing bracket 42. Arc-shaped depressions and arc-shaped protrusions alternate along the entire outer periphery of the flange 36*b*.

The flange 36*b* of the swing restriction member 36 is restricted from swinging with respect to the connecting part 34*c* of the adjustment screw member 34 by the tubular portion 36*a* being attached to the connecting part 34*c*. In this state, the flange 36*b* is pressed into contact with the second side face 42*a* of the second vertical swing bracket 42 by the compression spring 37. Accordingly, rotating the rotation knob 34*b* of the adjustment screw member 34 to adjust the length of the screw part 34*d* that is screwed in adjusts the pressure of the flange 36*b* on the second side face 42*a* of the second vertical swing bracket 42.

The fixing pin 35 attached to the second side face 31*d* of the positioning body 31 passes through the through-hole 42*h* formed on the second side face 42*a* of the second vertical swing bracket 42 and engages with one of the depressions along the outer periphery of the flange 36*b* of the swing restriction member 36. Since the flange 36*h* of the swing restriction member 36 is pressed against the second side face 42*a* of the second vertical swing bracket 42, when the second vertical swing bracket 42 is swung vertically, the second side face 42*a* exerts a force to cause the swing restriction member 36 to swing in conjunction. However, since the fixing pin 35 is engaged with one of the depressions along the outer periphery of the flange 36*b*, there is no risk of the swing restriction member 36 swinging along with the second vertical swing bracket 42.

A spring catch member 41*e* is provided on the first side face 41*a* of the first vertical swing bracket 41, closer to the front side (the side in the x direction) than the first guide hole 41*d* and extending towards the second side face 42*a*. The spring catch member 41*e* is bent at nearly a right angle from the first side face 41*a* towards the second side face 42*a*. The back end (the end in the direction opposite the x direction) of an extension spring 43 catches in the spring catch member 41*e*. As described below, the front end (the end in the x direction) of the extension spring 43 catches in the operation member 50 and pulls the operation member 50 towards the positioning body 31.

The operation member 50 is provided to be slidable laterally (in the x direction and the opposite direction) with respect to the first vertical swing bracket 41 and the second vertical swing bracket 42 of the second support member 40. The operation member 50 has a slider 51 and a pull mechanism 52. The slider 51 is provided so as to slide laterally along the second bottom face 42*b* of the second vertical swing bracket 42. The pull mechanism 52 is attached to the front end (the end in the x direction) of the slider 51.

The slider 51 is formed from metal or other plate material and has a bottom face 51*a*, a first lateral face 51*b*, and a second lateral face 51*c*. The bottom face 51*a* is positioned to be slidable on the second bottom face 42*b* of the second vertical swing bracket 42. The first lateral face 51*b* is bent at nearly a right angle upwards from the left edge of the bottom face 51*a* along the first side face 41*a* of the first vertical swing bracket 41. The second lateral face 51*c* is bent at nearly a right angle upwards from the right edge of the bottom face 51*a* along the second side face 42*a* of the second vertical swing bracket 42.

At the front end of the bottom face 51*a*, a front face 51*d* is provided. The front face 51*d* is bent at nearly a right angle upwards (in the z direction) from the bottom face 51*a*. The front face 51*d* of the slider 51 extends beyond the bottom face 51*a* to the left and right (y direction and opposite direction), and the pull mechanism 52 is attached to the front face 51*d*.

The second lateral face 51*c* located on the right side of the slider 51 has nearly a constant vertical height, except for the front end (the end in the x direction). A first guide pin 53 is provided in a horizontal position at the upper part of the lateral surface of the second lateral face 51*c*, closer to the front end (the end in the x direction) than the lateral center of the second lateral face 51*c*. A second guide pin 54 is provided in a horizontal position at the lower part of the lateral surface of the second lateral face 51*c*, closer to the rear end (the end in the direction opposite the x direction) of the second lateral face 51*c*. The diameter of the tip of both the first guide pin 53 and the second guide pin 54 is the minor diameter of the pins, and the diameter of the base of the pins next to the second lateral face 51*c* is the major diameter.

The bottom face 51*a* of the slider 51 is located between the first side face 41*a* of the first vertical swing bracket 41 and the second side face 42*a* of the second vertical swing bracket 42. The tips of the first guide pin 53 and the second guide pin 54, having the minor diameter, are respectively inserted into the front slide hole 42*f* and the central slide hole 42*g* provided in the second side face 42*a* so as to slide therein. The first guide pin 53 and the second guide pin 54 are retained in the front slide hole 42*f* and the central slide hole 42*g* by retaining rings (E rings) 57 and 58 respectively. The base of the first guide pin 53 and the second guide pin 54, having the major diameter, abut against the second side face 42*a*.

By the first guide pin 53 and the second guide pin 54 sliding along the direction of length of the front slide hole 42*f* and the central slide hole 42*g*, the slider 51 slides in the same direction.

The first lateral face 51*b* of the slider 51 is vertically higher at the back side (the side in the direction opposite the x direction) than at the front side (the side in the x direction). On the lateral surface of the upper part at this back side, a first lock pin 55 is provided in a horizontal position.

A second lock pin 56 is also provided in a horizontal position on the lateral surface of the upper part at the back side of the second lateral face 51*c*. The first lock pin 55 and the second lock pin 56 are shafts having the same shape and being provided respectively on the first lateral face 51*b* and the second lateral face 51*c* at the same vertical height and along the same axis.

The first lock pin 55 is inserted in the first guide hole 41*d* provided on the first side face 41*a* of the first vertical swing bracket 41 and is engaged in a slidable manner in the first guide hole 41*d*. The second lock pin 56 is inserted in the second guide hole 42*d* provided on the second side face 42*a* of the second vertical swing bracket 42 and is engaged in a slidable manner in the second guide hole 42*d*.

Due to the slider 51 sliding, the first lock pin 55 and the second lock pin 56 slide in the same direction. Accordingly, the direction in which the first lock pin 55 and the second lock pin 56 slide is the same as the direction in which the first guide pin 53 and the second guide pin 54 slide, namely along the direction of length of the front slide hole 42*f* and the central slide hole 42*g*.

When the first lock pin 55 and the second lock pin 56 are slid to be positioned at the back end (the end in the direction opposite the x direction) of the first guide hole 41*d* and the second guide hole 42*d* respectively, the first lock pin 55 and the second lock pin 56 either have entered through one of the openings 3*x*1, 31*y*1, and 31*z*1 respectively of the first engaging groove 31*x*, second engaging groove 31*y*, and third engaging groove 31*z* provided at the front end (the end in the x direction) of the first side face 31*c* and the second side face 31*d* in the positioning body 31, or are located below the third engaging groove 31*z*.

By contrast, when slid to be positioned at the front end (the end in the x direction) of the first guide hole 41*d* and the second guide hole 42*d*, the first lock pin 55 and the second lock pin 56 are respectively pulled to the front (x direction) of the first engaging groove 31*x*, second engaging groove 31*y*, and third engaging groove 31*z*.

Figure 8:
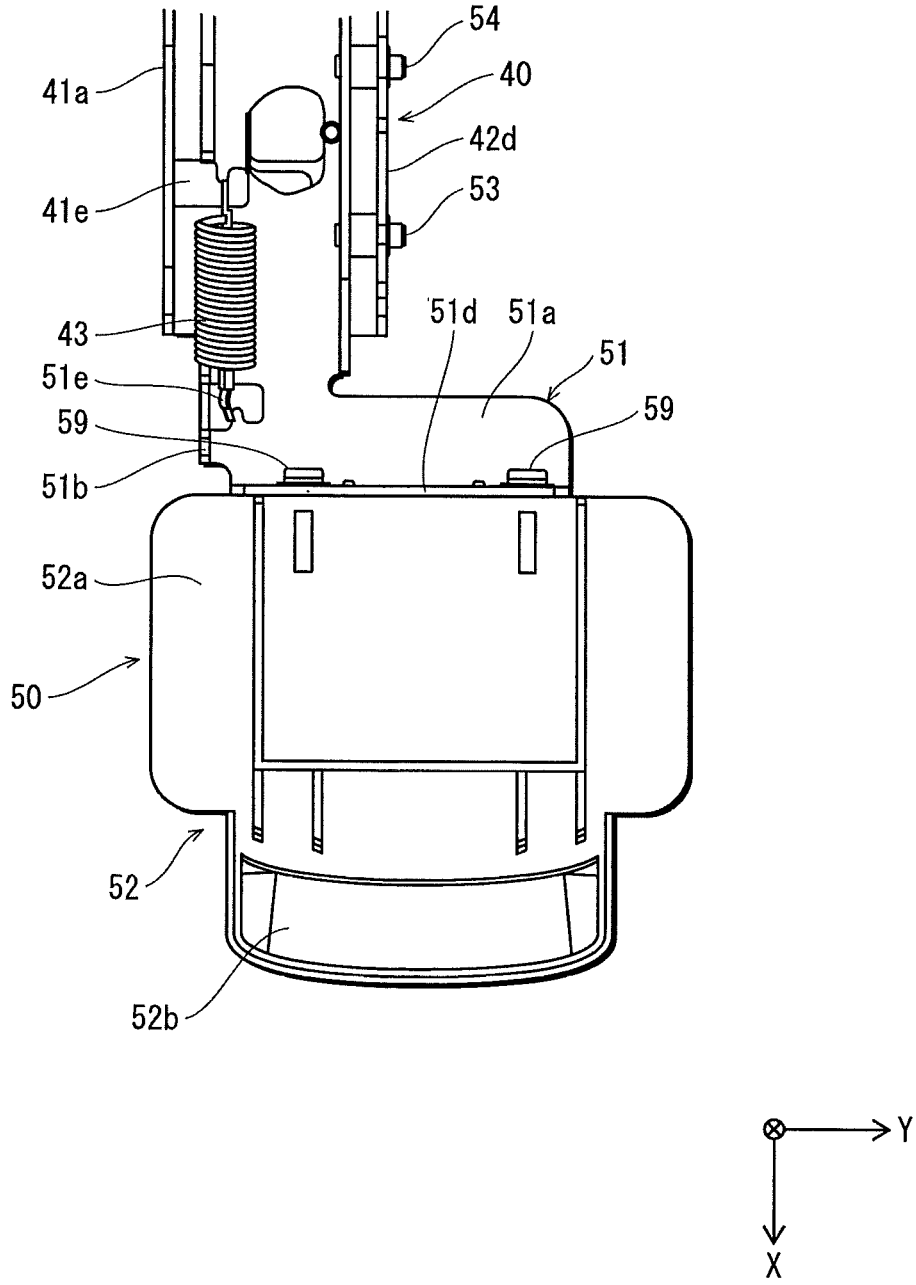
FIG. 8 is a plan view showing an operation member provided in the control panel support mechanism along with part of a second support member.

FIG. 8 is a plan view showing a main part of the operation member 50 along with part of the second support member 40. A spring catch member 51*e* is provided near the front end (the end in the x direction) of the first lateral face 51*b* in the slider 51. The spring catch member 51*e* is bent at nearly a right angle from the upper edge (the edge in the z direction) towards the second lateral face 51*c*. The front end of the extension spring 43 catches on the spring catch member 51*e*. The back end (the end in the direction opposite the x direction) of the extension spring 43 catches on the spring catch member 41*e* provided on the first side face 41*a* of the first vertical swing bracket 41, as described above. The slider 51 is thus pulled towards the back (in the direction opposite the x direction) by the extension spring 43.

The pull mechanism 52 attached to the front face 51*d* of the slider 51 is a resin molding and has a rectangular pull-handle body 52*a* shaped as a flat plate and a handle 52*b* projecting downwards from the front end (the end in the x direction) of the pull-handle body 52*a*. A back face 52*c* (see FIG. 6) is provided on the pull-handle body 52*a* at the end of the slider 51 extending downwards (in the opposite direction of the z direction). The back face 52*c* abuts against the front face 51*d* of the slider 51 and is attached to the front face 51*d* by a pair of bolts 59. The handle 52*b* is positioned below the front end (the end in the x direction) of the control panel 10. The handle 52*b* projects from the cover 61, i.e. is uncovered.

Figure 9:
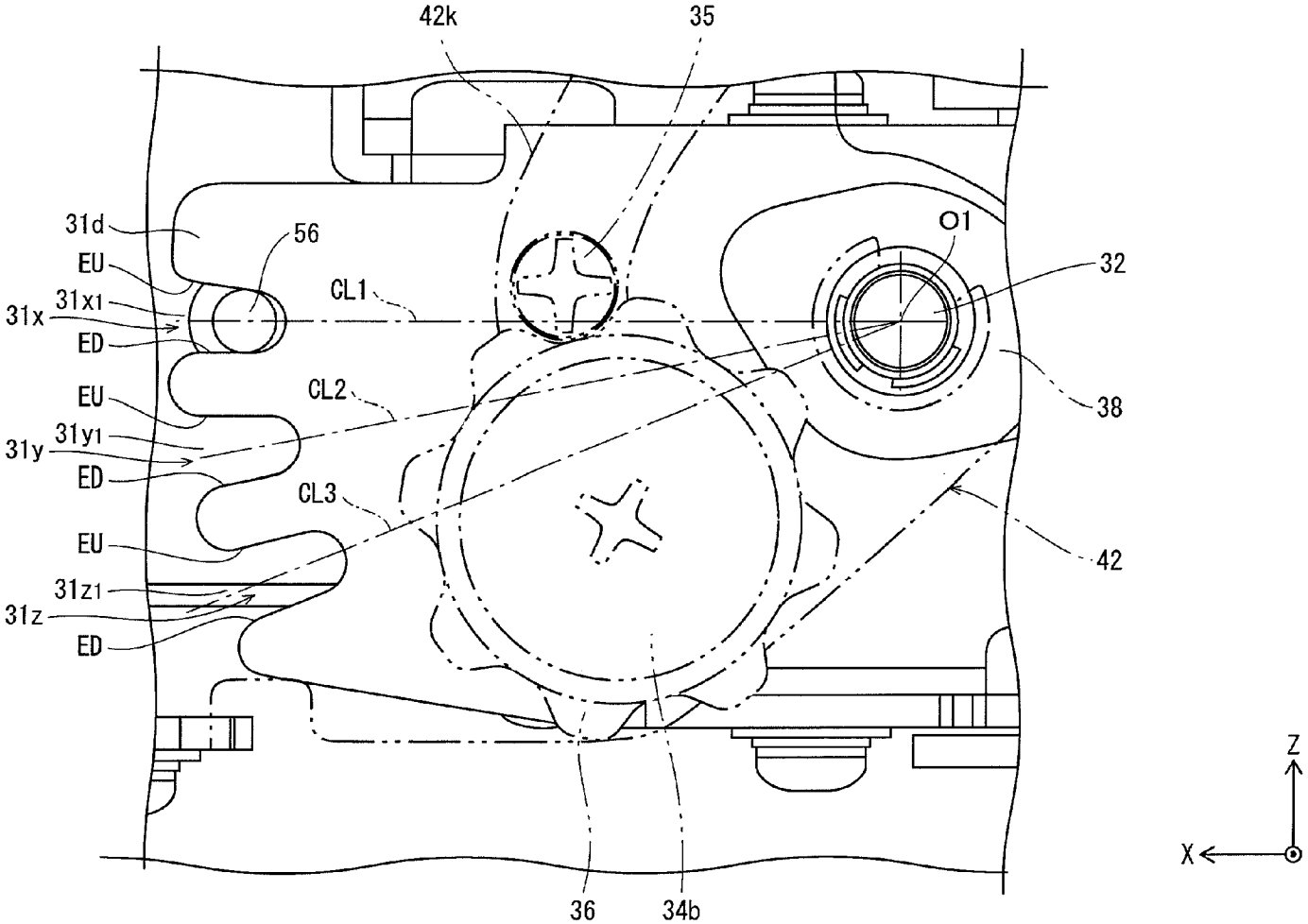
FIG. 9 is an enlarged diagram of the right side of the first support member in order to illustrate operation of the control panel support mechanism.
Figure 10:
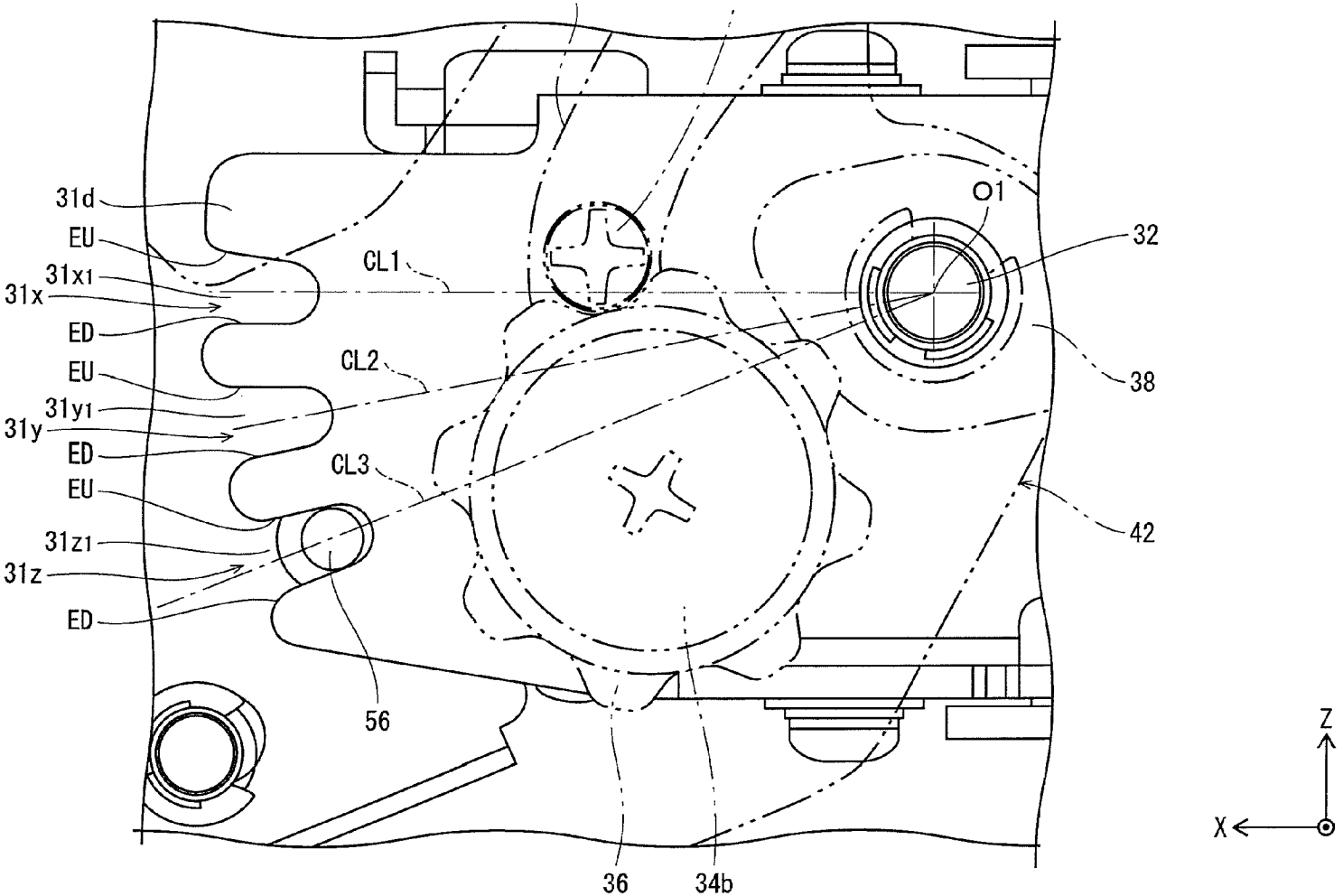
FIG. 10 is an enlarged diagram of the right side of the first support member in order to illustrate operation of the control panel support mechanism.

FIGS. 9 and 10 are enlarged diagrams of the front end (the end in the x direction) of the side face 31*d* on the right side (the side in the y direction) of the positioning body 31 in the first support member 30. Note that FIG. 9 shows the second lock pin 56, provided on the second lateral face 51*c* of the slider 51, engaged with the uppermost first engaging groove 31*x* in the front end (the end in the x direction) of the second side face 31*d*, whereas FIG. 10 shows the second lock pin 56 engaged with the lowest third engaging groove 31*z*.

The first engaging groove 31*x*, second engaging groove 31*y*, and third engaging groove 31*z* provided on the first side face 31*c* and the second side face 31*d* have the same structure. Therefore, the following explanation focuses on the structure at the edge of the second side face 31*d*, omitting a description of the structure at the edge of the first side face 31*c*.

The first engaging groove 31*x*, second engaging groove 31*y*, and third engaging groove 31*z* each have an upper edge EU and a lower edge ED. These edges extend from the openings 31*x*1, 31*y*1, and 31*z*1 towards the swing center O1, i.e. the axis of the vertical swing shaft 32. Central axes CL1, CL2, and CL3 are straight lines extending in a radial direction from the swing center O1 and each traversing a point located centrally between the upper edge EU and the lower edge ED respectively of the first engaging groove 31*x*, second engaging groove 31*y*, and third engaging groove 31*z*.

Figure 11:
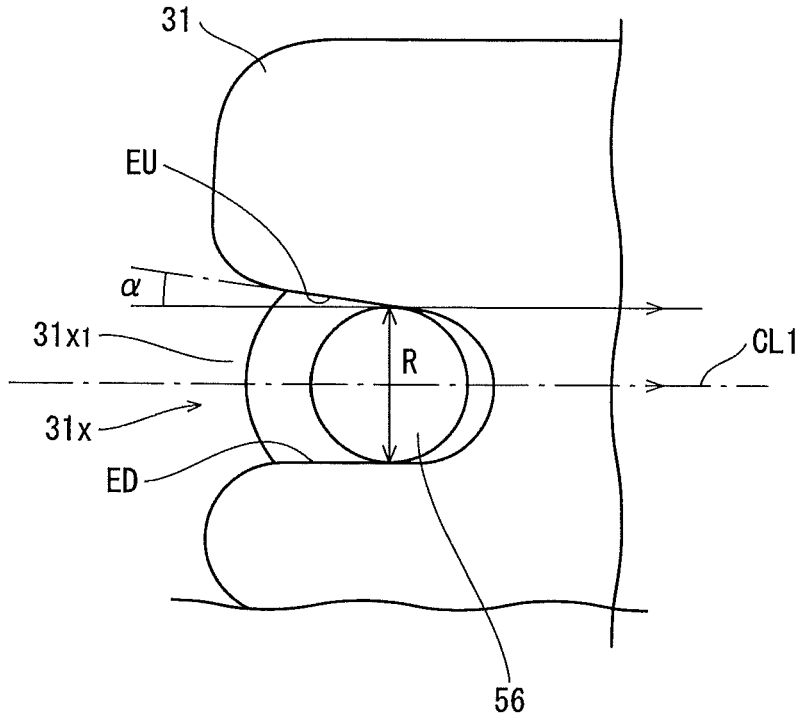
FIG. 11 is an enlarged diagram of the main part of the right side of the first support member in order to illustrate the relationship between an uppermost engaging groove and a lock pin in the control panel support mechanism.
Figure 11:
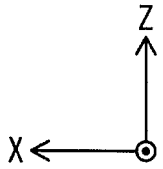

FIG. 11 is an enlarged diagram of the periphery of the first engaging groove 31*x*, showing the relationship between the first engaging groove 31*x* and the second lock pin 56. Excluding the opening 31*x*1 and the back of the groove, the upper edge EU of the first engaging groove 31*x* is inclined to gradually rise (in the z direction) as the upper edge EU nears the opening 31*x*1. The angle of inclination a is, for example, 10°.

Excluding the opening 31*x*1 and the back of the groove, the lower edge ED of the first engaging groove 31*x* is nearly parallel to the central axis CL1 of the first engaging groove 31*x*. The back of the first engaging groove 31*x* is a semi-circle with a smaller diameter than the diameter R of the second lock pin 56 (and the first lock pin 55). The upper edge EU and the lower edge ED are both connected to the semi-circular back of the groove. At the opening 31*x*1 of the first engaging groove 31*x*, the upper edge EU and the lower edge ED are curved in an arc respectively upwards (in the z direction) and downwards (in the direction opposite to the z direction). Apart from how the central axes CL2 and CL3 are inclined from the central axis CL1 at predetermined angles, the second engaging groove 31*y* and the third engaging groove 31*z* have almost the same structure as the first engaging groove 31*x*. Accordingly, excluding the openings 31*y*1 and 31*z*1 and the backs of the grooves, the upper edges EU of the second engaging groove 31*y* and the third engaging groove 31*z* are inclined upwards at a 10° angle from the central axes CL2 and CL3 respectively as the upper edges near their respective openings. The lower edges ED are parallel to the central axes CL2 and CL3 respectively.

The length of the first engaging groove 31*x* through the third engaging groove 31*z* in the direction of length from the openings 31*x*1-31*z*1 to the backs of the grooves is equivalent. So that the second lock pin 56 cannot easily be extracted from the first engaging groove 31*x* through the third engaging groove 31*z*, the length is approximately 1.5 times the diameter R of the second lock pin 56.

The second engaging groove 31*y* is positioned between the first engaging groove 31*x* and the third engaging groove 31*z* with an interval on either side. The interval has a width of, for example, approximately the radius R of the second lock pin 56. The sections between the second and first and between the second and third engaging grooves are arc-shaped projections facing the front (the x direction).

The first lock pin 55 and the second lock pin 56 provided on the slider 51 are pulled by the extension spring 43 to slide back (in the direction opposite the x direction). The first guide pin 53 and the second guide pin 54 provided on the slider 51 are guided by the front slide hole 42*f* and the central slide hole 42*g* so as to slide in the direction of length of these holes. The front slide hole 42*f* is aligned radially with respect to the swing center O1, and the central slide hole 42*g* is parallel to the front slide hole 42*f*. Therefore, the slider 51 slides in a direction radial to the swing center O1.

The first lock pin 55 and the second lock pin 56 thus also slide in a direction radial to the swing center O1. Accordingly, if the first lock pin 55 and the second lock pin 56 are pulled back (in the direction opposite the x direction) by the extension spring 43 while, for example, located in front (in the x direction) of the openings 31*x*1 of the first engaging grooves 31*x*, the first lock pin 55 and second lock pin 56 pass through the openings 31*x*1 and enter into the first engaging grooves 31*x*.

When pulled by the extension spring 43 to enter into the first engaging grooves 31*x*, the first lock pin 55 and the second lock pin 56 are guided by the upper edges EU and the lower edges ED and move to the back of the grooves. The gap between the upper edge EU and the lower edge ED gradually decreases towards the back of the first engaging groove 31*x*. Therefore, the first lock pin 55 and the second lock pin 56 come into point-contact with the upper edges EU and the lower edges ED and engage with the first engaging grooves 31*x*. The first lock pin 55 and the second lock pin 56 are thus locked so as not to move vertically within the first engaging grooves 31*x*.

In the second engaging groove 31*y* and the third engaging groove 31*z* as well, the first lock pin 55 and the second lock pin 56 similarly come into point-contact with the upper edges EU and the lower edges ED and are locked so as not to move vertically. The first lock pin 55 and the second lock pin 56 thus form a locking mechanism in the first engaging groove 31*x*, second engaging groove 31*y*, and third engaging groove 31*z*.

In a control panel assembly A with this sort of structure, if as shown in FIG. 9 the first lock pin 55 and the second lock pin 56 are engaged in the uppermost first engaging grooves 31*x* provided in the first side face 31*c* and the second side face 31*d* of the positioning body 31, then as shown in FIG. 3, the input control unit 11 and the operation screen 11*a* in the control panel 10 are inclined at an angle of 5°-10° with respect to the horizon, with the front side (the side in the x direction) being positioned lower than the back side. The display screen 12*a* of the display unit 12 is inclined at an angle of 160°-170° with respect to the operation screen 11*a* of the input control unit 11 with the front side (the side in the x direction) being positioned lower than the back side.

If the ten-key or other input unit provided on the operation screen 11*a* of the input control unit 11 is pressed with the input control unit 11 in this position, a force is exerted on the first lock pin 55 and the second lock pin 56 to swing downwards (in the direction opposite the z direction) around the vertical swing shaft 32. However, since the first lock pin 55 and the second lock pin 56 are engaged with the first engaging grooves 31*x* by being in point-contact with the upper edges EU and the lower edges ED due to being pulled by the extension spring 43, there is no risk of the first lock pin 55 and the second lock pin 56 vibrating in the first engaging grooves 31*x*. Accordingly, the input member of the input control unit 11 can be stably operated.

Furthermore, since the lower edges ED of the first engaging grooves 31*x* are parallel to a direction radial to the vertical swing shaft 32, a force applied vertically downwards (in the direction opposite to the z direction) to the operation screen 11*a* of the input control unit 11, which is inclined with respect to the horizon so that the front (the side in the x direction) of the operation screen 11*a* is positioned lower than the back, acts on the lower edges ED of the first engaging groove 31*x* in the direction opposite the x direction. Therefore, even if a large force is applied to the operation screen 11*a* of the input control unit 11, the first lock pin 55 and the second lock pin 56 are prevented from being extracted from the first engaging grooves 31*x*.

The distance between the upper edge EU and the lower edge ED in each of the first engaging grooves 31*x* grows larger closer to the opening 31*x*1 and grows smaller closer to the back of the grooves. Therefore, when the first lock pin 55 and the second lock pin 56 enter into the first engaging grooves 31*x*, only a portion of the first lock pin 55 and the second lock pin 56 along the shaft direction of each pin is in contact with a portion of the upper edges EU and the lower edges ED in the direction of length thereof. As a result, the area over which the pins slide is small, thus preventing wear on the upper and lower edges.

Furthermore, even if the first lock pin 55 and the second lock pin 56 slide against the upper edges EU and the lower edges ED of the first engaging grooves 31*x*, thus causing wear, the pins are maintained in engagement with the upper edges EU and the lower edges ED of the first engaging grooves 31*x*, since the extension spring 43 pulls the pins to the back (in the direction opposite the x direction) of the first engaging grooves 31*x*. As a result, the first lock pin 55 and the second lock pin 56 engage in the first engaging grooves 31*x* so as to be locked without vibrating vertically.

The second engaging grooves 31*y* and the third engaging grooves 31*z* have the same structure as the first engaging groove 31*x*, and therefore the first lock pin 55 and the second lock pin 56 securely engage with the upper edges EU and the lower edges ED of the second engaging groove 31*y* and the third engaging groove 31*z* as well. The first lock pin 55 and the second lock pin 56 thus engage in the second engaging grooves 31*y* and the third engaging grooves 31*z* so as to be locked without vibrating vertically.

Figure 12:
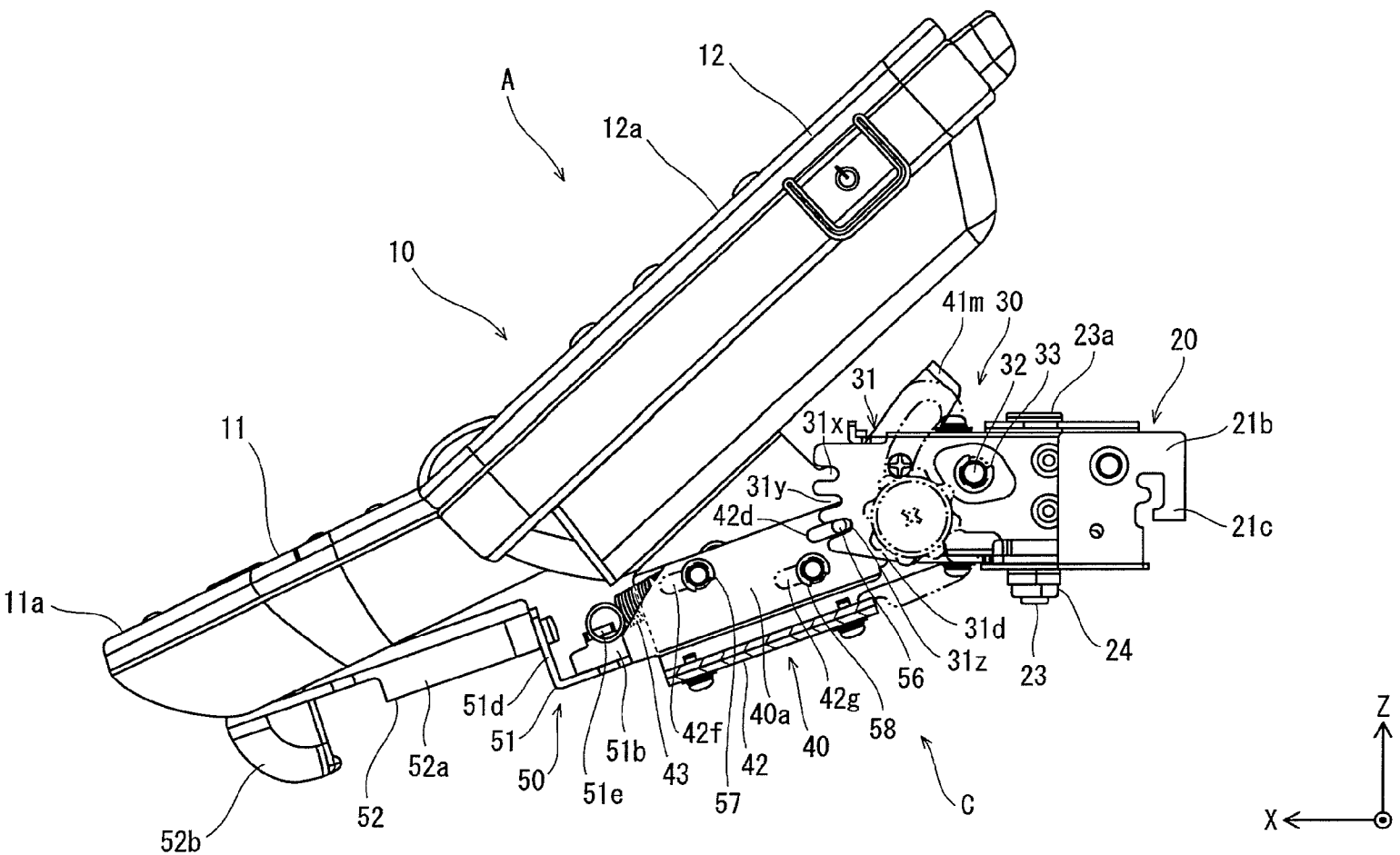
FIG. 12 is a right-side view of the control panel assembly when the control panel is at a predetermined inclination, showing a cross-section of the control panel support mechanism.

FIG. 12 is a side view of the control panel assembly when the second lock pin 56 is engaged in the third engaging grooves 31*z*.

To swing the control panel 10 downwards (in the direction opposite the z direction) when the first lock pin 55 and the second lock pin 56 are engaged in the first engaging grooves 31*x*, the user pulls the handle 52*b* of the pull mechanism 52, provided at the bottom (in the direction opposite the z direction) of the front end (the end in the x direction) of the control panel 10, forwards (in the x direction). The slider 51, which is integrated with the pull mechanism 52, is thus pulled forwards (in the x direction) away from the second support member 40. The first guide pin 53 and the second guide pin 54 provided on the second lateral face 51*c* of the slider 51 slide in the direction of length of the front slide hole 42*f* and the central slide hole 42*g* provided in the second side face 42*a* of the second vertical swing bracket 42.

The first lock pin 55 and the second lock pin 56 provided at the back end (the end in the direction opposite the x direction) of the slider 51 thus also slide in the same direction and are released from engagement with the upper edges EU and the lower edges ED of the first engaging grooves 31*x*, being pulled forwards (in the x direction) through the openings 31*x*1.

Once the first lock pin 55 and the second lock pin 56 are pulled out of the first engaging grooves 31*x*, the first vertical swing bracket 41 and the second vertical swing bracket 42 in the second support member 40 become vertically swingable around the vertical swing shaft 32.

At this point, the load of the control panel 10 is placed on the second support member 40 that supports the control panel 10. At this point, if the user swings the handle 52*b* downwards (in the direction opposite the z direction), the first lock pin 55 and the second lock pin 56, which have been pulled out of the first engaging grooves 31*x*, swing downwards along the arc-shaped projections that extend forward (in the x direction) between the first engaging grooves 31*x* and the second engaging grooves 31*y*.

Subsequently, upon facing the openings 31*y*1 of the second engaging grooves 31*y*, the first lock pin 55 and the second lock pin 56 are pulled by the extension spring 43 into the second engaging grooves 31*y*. At this point, if the user stops pulling on the handle 52*b*, the first lock pin 55 and the second lock pin 56 are pulled by the extension spring 43 through the openings 31$y$1 in the second engaging grooves 31$y$ and into the second engaging grooves 31$y$.

The first lock pin 55 and the second lock pin 56 are thus pulled into the second engaging grooves 31$y$ by the extension spring 43, are guided by the upper edges EU and the lower edges ED of the second engaging grooves 31$y$ to move to the back of the grooves, and engage in point-contact with the upper edges EU and the lower-edges ED. The first lock pin 55 and the second lock pin 56 are thus locked so as not to move vertically within the second engaging grooves 31$y$.

In this position, the operation screen 11$a$ of the input control unit 11 in the control panel 10 is locked at a predetermined inclination angle of approximately 20°-30° with respect to the horizon. Even if the user operates the input unit of the input control unit 11, the control panel 10 does not vibrate and can be stably operated. Furthermore, the first lock pin 55 and the second lock pin 56 are controlled from being extracted from the second engaging grooves 31$y$.

In order to engage the first lock pin 55 and the second lock pin 56 with the third engaging grooves 31$z$ when the pins are engaged in the first engaging grooves 31$x$ or the second engaging grooves 31$y$, the pull mechanism 52 of the operation member 50 is operated as described above. Furthermore, in order to engage the first lock pin 55 and the second lock pin 56 with the first engaging grooves 31$x$ or the second engaging grooves 31$y$ when the pins are respectively engaged in the second engaging grooves 31$y$ or the third engaging grooves 31$z$, operations are as described above, except that the operation member 50 is swung upwards.

Figure 13:
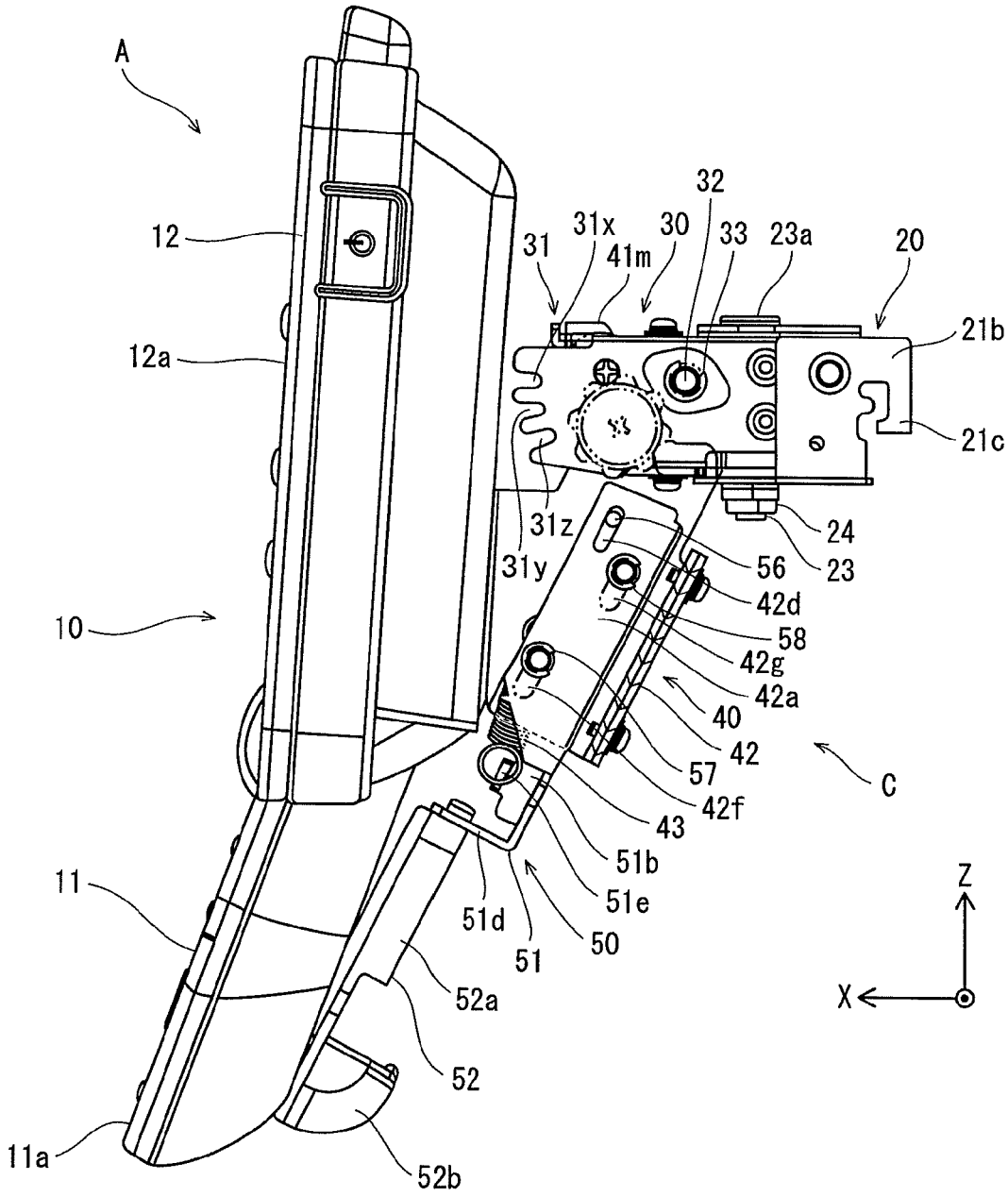
FIG. 13 is a right-side view of the control panel assembly when the control panel is vertical, showing a cross-section of the control panel support mechanism.

When the handle 52$b$ of the pull mechanism 52 is pulled, and the first lock pin 55 and the second lock pin 56 are swung downwards (in the direction opposite the z direction) so as to be located below (in the direction opposite the z direction) the third engaging groove 31$z$, the first lock pin 55 and the second lock pin 56 become unlocked and are not fitted into any of the first engaging grooves 31$x$ through the third engaging grooves 31$z$. In this case, as shown in FIG. 13, the display unit 12 becomes nearly perpendicular due to the weight of the control panel 10.

In this state, the swing restriction member 41$m$ provided in the first vertical swing bracket 41 engages with the upper face 31$a$ of the first support member 30. The second support member 40, which hangs from the vertical swing shaft 32, is thus restricted from swinging around the vertical swing shaft 32 by the swing restriction member 41$m$. This maintains the control panel 10 in a nearly vertical position.

When the control panel 10 is thus in a vertical position, the amount by which the control panel 10 protrudes forward (in the x direction) from the image forming apparatus body B is reduced as compared to when the control panel 10 is locked in a predetermined position due to the first lock pin 55 and the second lock pin 56 being engaged with the first engaging grooves 31$x$, the second engaging grooves 31$y$, or the third engaging grooves 31$z$. Accordingly, the control panel 10 can be placed in this vertical position to prevent the control panel 10 from colliding with surrounding objects when, for example, moving the image forming apparatus body B.

Modifications

Figure 14:
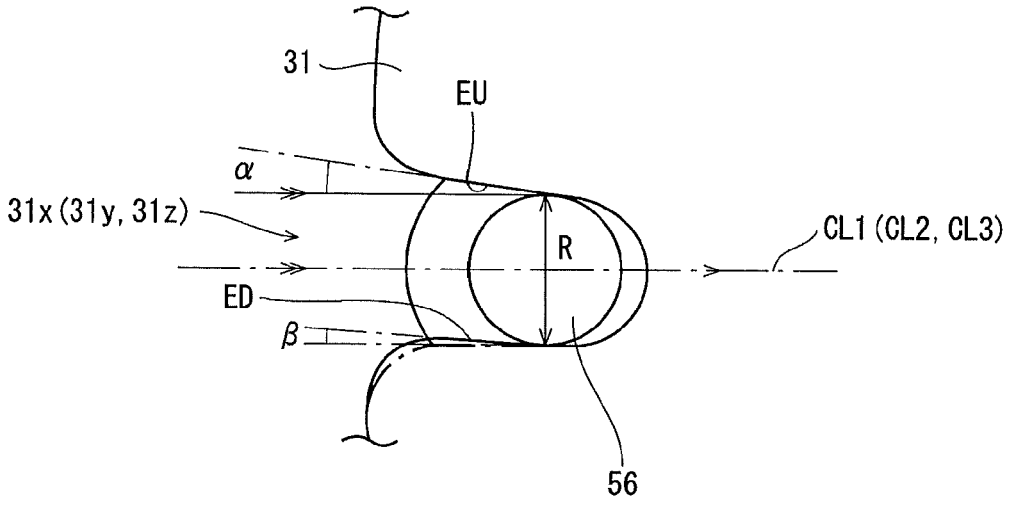
FIG. 14 is an enlarged diagram of the main part of the right side of the first support member in order to illustrate the relationship between an engaging groove and a lock pin in a modification.
Figure 14:
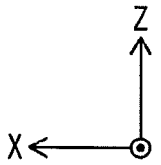

In the above embodiment, the lower edge ED of the first engaging grooves 31$x$ through the third engaging grooves 31$z$ is parallel to the central axes CL1-CL3 of the first engaging grooves 31$x$ through the third engaging grooves 31$z$, yet the present invention is not limited to this structure. For example, as shown in FIG. 14, the lower edge ED of the first engaging grooves 31$x$ through the third engaging grooves 31$z$ may be inclined at a predetermined inclination angle 13 with respect to the central axes CL1-CL3 so that the front side (the side in the x direction) of the lower edge ED is positioned higher than the back side.

This inclination angle β is smaller than the inclination angle α of the upper edge EU with respect to the central axes CL1-CL3, for example approximately 5°. In this case as well, the gap between the upper edge EU and the lower edge ED gradually increases towards the openings 31$x$1, 31$y$1, and 31$z$1. Therefore, the gap gradually decreases towards the back of the grooves.

With this sort of structure, when the first lock pin 55 and the second lock pin 56 are engaged in one set of the first engaging grooves 31$x$ through the third engaging grooves 31$z$, and a vertical force is applied downwards (in the direction opposite the z direction) on the operation screen 11$a$ of the input control unit 11, then the force applied on the lower edge ED, with which the first lock pin 55 and the second lock pin 56 are in point-contact, only acts in the direction towards the back of the grooves. As a result, the first lock pin 55 and the second lock pin 56 are reliably prevented from being extracted from the first engaging grooves 31$x$ through the third engaging grooves 31$z$ when engaged in any of these grooves.

Summary of Embodiment

As described above, in the control panel support mechanism according to the present invention, a lock member that enters into one of a plurality of vertically disposed engaging grooves through an opening therein engages with the engaging groove, due to the bias of a biasing unit, and is locked therein. As a result, the locking member is reliably prevented from vibrating vertically within the engaging groove. Furthermore, the forcing unit forces the lock member to engage with the engaging groove, and therefore even if the engaged portions of the lock member and the engaging groove become worn, the force of the forcing unit maintains the lock member and the engaging groove in engagement.

Accordingly, the present invention is useful as technology for preventing a control panel mounted on an image forming apparatus from vibrating during input or other operations.

Preferably, each of the plurality of engaging grooves has an upper edge and a lower edge, respectively located above and below the lock member when the lock member has entered the engaging groove through the opening, and a distance between the upper edge and the lower edge continually decreases towards the swing axis so that the lock member locks in engagement with the engaging groove by coming into point-contact with the upper edge and the lower edge.

Preferably, the upper edge of each of the plurality of engaging grooves is inclined at a first inclination angle with respect to the radial direction along which the engaging groove is positioned, so that the upper edge gradually rises with respect to the radial direction as the upper edge nears the opening.

Preferably, the lower edge of each of the plurality of engaging grooves is inclined at a second inclination angle with respect to the radial direction along which the engaging groove is positioned, so that the lower edge gradually rises with respect to the radial direction as the lower edge nears the opening, the second inclination angle being smaller than the first inclination angle.

Preferably, the first support member has a flat vertical face, in which the plurality of engaging grooves are formed, and the lock member is a shaft, an axis of which is perpendicular to a direction in which the biasing unit biases the lock member.

Preferably, the first support member has a pair of the faces, and the lock member is provided for each of the pair of the faces to engage with one of the plurality of engaging grooves.

Preferably, between each of the plurality of engaging grooves, an end of the face is an arc-shaped projection, a tip of the projection being located upstream in a direction in which the lock member enters the each of the plurality of engaging grooves.

Preferably, the control panel support mechanism further comprises an operation member configured to unlock the lock member from engagement with any of the plurality of engaging grooves by being slid against a bias imparted by the biasing unit.

A control panel assembly according to the present invention comprises: a control panel of an image forming apparatus; and a control panel support mechanism supporting the control panel so that the control panel is vertically swingable with respect to the image forming apparatus, the control panel support mechanism including: a first support member configured to be attached to the image forming apparatus; a second support member configured to support the control panel and axially supported by the first support member to be vertically swingable with respect to the first support member; a lock member configured to be slidable towards or away from a swing axis of the second support member; and a biasing unit configured to bias the lock member to slide towards the swing axis, wherein the first support member has a plurality of engaging grooves each positioned along a radial direction with respect to the swing axis and having an opening at an end of the first support member opposite the swing axis, the plurality of engaging grooves being aligned vertically, and the biasing unit biases the lock member so that the lock member enters one of the plurality of engaging grooves through the opening to lock in engagement with the engaging groove.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A control panel support mechanism for supporting a control panel of an image forming apparatus so that the control panel is vertically swingable with respect to the image forming apparatus, the control panel support mechanism comprising:

a first support member configured to be attached to the image forming apparatus;

a second support member configured to support the control panel and axially supported by the first support member to be vertically swingable with respect to the first support member;

a lock member configured to be slidable towards or away from a swing axis of the second support member; and a biasing unit configured to bias the lock member to slide towards the swing axis, wherein the first support member has a plurality of engaging grooves each positioned along a radial direction with respect to the swing axis and having an opening at an end of the first support member opposite the swing axis, the plurality of engaging grooves being aligned vertically, the biasing unit biases the lock member so that the lock member enters one of the plurality of engaging grooves through the opening to lock in engagement with the engaging groove, and each of the plurality of engaging grooves has an upper edge and a lower edge, respectively located above and below the lock member when the lock member has entered the engaging groove through the opening, and a distance between the upper edge and the lower edge continually decreases towards the swing axis so that the lock member locks in engagement with the engaging groove by coming into point-contact with the upper edge and the lower edge.

2. The control panel support mechanism of claim 1, wherein the upper edge of each of the plurality of engaging grooves is inclined at a first inclination angle with respect to the radial direction along which the engaging groove is positioned, so that the upper edge gradually rises with respect to the radial direction as the upper edge nears the opening.

3. The control panel support mechanism of claim 2, wherein the lower edge of each of the plurality of engaging grooves is inclined at a second inclination angle with respect to the radial direction along which the engaging groove is positioned, so that the lower edge gradually rises with respect to the radial direction as the lower edge nears the opening, the second inclination angle being smaller than the first inclination angle.

4. The control panel support mechanism of claim 1, wherein the first support member has a flat vertical face, in which the plurality of engaging grooves are formed, and the lock member is a shaft, an axis of which is perpendicular to a direction in which the biasing unit biases the lock member.

5. The control panel support mechanism of claim 4, wherein the first support member has a pair of the faces, and the lock member is provided for each of the pair of the faces to engage with one of the plurality of engaging grooves.

6. The control panel support mechanism of claim 1, further comprising:

an operation member configured to unlock the lock member from engagement with any of the plurality of engaging grooves by being slid against a bias imparted by the biasing unit.

7. A control panel assembly comprising:

a control panel of an image forming apparatus; and the control panel support mechanism of claim 1 supporting the control panel.

8. The control panel assembly of claim 7, wherein the control panel has an input control unit configured to be operated for input of a variety of information and a display unit configured to display the variety of information, and the input control unit is supported by the second support member with the display unit being positioned closer to the first support member than the input control unit.

9. The control panel assembly of claim 7, wherein the upper edge of each of the plurality of engaging grooves is inclined at a first inclination angle with respect to the radial direction along which the engaging groove is positioned, so that the upper edge gradually rises with respect to the radial direction as the upper edge nears the opening.

10. The control panel assembly of claim 7, wherein the lower edge of each of the plurality of engaging grooves is inclined at a second inclination angle with respect to the radial direction along which the engaging groove is positioned, so that the lower edge gradually rises with respect to the radial direction as the lower edge nears the opening, the second inclination angle being smaller than the first inclination angle.

11. An image forming apparatus comprising:

a control panel; and the control panel support mechanism of claim 1 supporting the control panel.

12. The image forming apparatus of claim 11, wherein the control panel has an input control unit configured to be operated for input of a variety of information and a display unit configured to display the variety of information, and the input control unit is supported by the second support member with the display unit being positioned closer to the first support member than the input control unit.

13. The image forming apparatus of claim 11, wherein the upper edge of each of the plurality of engaging grooves is inclined at a first inclination angle with respect to the radial direction along which the engaging groove is positioned, so that the upper edge gradually rises with respect to the radial direction as the upper edge nears the opening.

14. The image forming apparatus of claim 11, wherein the lower edge of each of the plurality of engaging grooves is inclined at a second inclination angle with respect to the radial direction along which the engaging groove is positioned, so that the lower edge gradually rises with respect to the radial direction as the lower edge nears the opening, the second inclination angle being smaller than the first inclination angle.

15. A control panel support mechanism, for supporting a control panel of an image forming apparatus so that the control panel is vertically swingable with respect to the image forming apparatus, the control panel support mechanism comprising:

a first support member configured to be attached to the image forming apparatus;

a second support member configured to support the control panel and axially supported by the first support member to be vertically swingable with respect to the first support member:

a lock member configured to be slidable towards or away from a swing axis of the second support member; and a biasing unit configured to bias the lock member to slide towards the swing axis, wherein the first support member has a plurality of engaging grooves each positioned along a radial direction with respect to the swing axis and having an opening at an end of the first support member opposite the swing axis, the plurality of engaging grooves being aligned vertically, and the biasing unit biases the lock member so that the lock member enters one of the plurality of engaging grooves through the opening to lock in engagement with the engaging groove;

wherein the first support member has a flat vertical face, in which the plurality of engaging grooves are formed, the lock member is a shaft, an axis of which is perpendicular to a direction in which the biasing unit biases the lock member, and between each of the plurality of engaging grooves, an end of the face is an arc-shaped projection, a tip of the projection being located upstream in a direction in which the lock member enters the each of the plurality of engaging grooves.

16. A control panel assembly comprising:

a control panel of an image forming apparatus; and the control panel support mechanism of claim 15 supporting the control panel.

17. An image forming apparatus comprising:

a control panel;

the control panel support mechanism of claim 15 supporting the control panel.

* * * * *